United States Patent [19]

Wheeler

[11] 3,960,186

[45] June 1, 1976

[54] WEFT YARN CONTROL DEVICE

[75] Inventor: Claude A. Wheeler, South Grafton, Mass.

[73] Assignee: Rockwell International Corporation, Pittsburgh, Pa.

[22] Filed: Apr. 7, 1975

[21] Appl. No.: 565,539

[52] U.S. Cl. ..... 139/450

[51] Int. Cl.[2] ..... D03D 47/34

[58] Field of Search ..... 139/122 R, 122 W, 122 H, 139/122 S, 123, 124 R, 127 R

[56] References Cited

UNITED STATES PATENTS

| | | | |
|---|---|---|---|
| 1,009,472 | 11/1911 | Clark | 139/122 R |
| 3,536,105 | 10/1970 | Piccoli | 139/122 H |

FOREIGN PATENTS OR APPLICATIONS

| | | | |
|---|---|---|---|
| 23,588 | 4/1967 | Japan | 139/122 H |

*Primary Examiner*—Henry S. Jaudon

[57] ABSTRACT

A control device for the weft yarn in shuttleless looms of the single pick insertion type having a selvage forming apparatus on the weft insertion side of the loom. The device includes a weft locating member which is effective in receiving and holding the weft yarn extending from a shed during movement of the loom's lay and reed toward beat-up position. The locating member positions the weft for reception by the selvage forming apparatus and by a cam member operatively associated therewith is effective in causing the weft to assume a position to affect its reception by the gripping element of the inserting carrier during movement of the lay and reed away from beat-up position.

1 Claim, 3 Drawing Figures

WEFT YARN CONTROL DEVICE

BACKGROUND OF THE INVENTION

1. Field of the Invention

In shuttleless looms which utilize weft yarn that is furnished from an outside source and is not carried to and fro through the shed by the shuttle or carrier itself, it is common practice to insert each pick of weft by two reciprocating elements. That element which introduces the weft into the warp shed is known as the inserting carrier and that which receives or has transferred to it the introduced weft to be drawn through the remainder of the shed is known as the weft receiving or extending carrier.

The shuttleless loom to which the instant invention is applicable is of the single pick insertion type wherein the weft yarn extends through an eyelet in the rear wall of the inserting carrier and remains threaded therethrough during the performance of said carrier's intended funtion. Additionally the shuttleless loom to which the instant invention is applicable utilized a selvage forming apparatus on the weft insertion side of the loom, of the type shown and described in U.S. Pat. No. 3,563,280. This apparatus severs the weft at a predetermined distance outwardly from the shed and then tucks the cut end into a reopened shed for beat-up with the next inserted length of yarn. In particular the invention pertains to an improved device for positioning the weft for reception by the selvage forming apparatus and to locate it so that it will enter the gripping portion of the inserting carrier upon initial movement of said carrier to introduce the next pick.

2. Description of the Prior Art

The above mentioned U.S. Pat. No. 3,563,280 shows and describes the type of selvage forming apparatus with which the present invention is operatively associated. This patent pertains to the apparatus which was originally developed for shuttleless looms wherein weft yarn is inserted into separate sheds of warp threads in pairs of interconnected picks by means of reciprocating flexible yarn carrying elements. This manner of inserting weft yarn is commonly referred to as the hairpin system and the apparatus of this patent eliminated the so-called fringe on one edge of the fabric by turning the fringe ends inwardly to a position where they are beat-up into the fabric. With the conversion of this type of loom to so-called pick and pick weaving in which single picks are inserted into the separate sheds of warp threads, a fringe is also formed on the weft insertion side of the fabric.

To eliminate the fringe on the weft insertion side of the loom a selvage forming apparatus like that disclosed in the above patent was developed by making many of its components in a manner so as to permit the apparatus to perform its function on the opposite or said weft insertion side.

When application of the selvage forming apparatus was made on the weft insertion side of the loom, the apparatus's weft cutter could not be utilized, for the weft's association with the inserting carrier would not permit that portion of the weft extending from the shed to be properly located so as to be cut by said weft cutter. In order to cut and then tuck the severed weft on this side of the loom it was necessary to utilize a conventional thread cutter and waste selvage threads. The waste selvage threads served to locate the weft so as to be received and held by the apparatus's clamping device prior to being acted upon by the conventional thread cutter and selvage needle that tucks the cut end into the next shed opening.

The combination of the selvage forming apparatus, conventional thread cutter, and the waste selvage threads for positioning the weft all being mounted in the same general area on the weft insertion side of the loom created an overcrowding condition of the various elements of these mechanisms and the accessibility to anyone for adjustment or replacement purposes was very difficult. Both the selvage forming apparatus and the conventional thread cutter had separate drives operatively connected to the loom's weft control housing which required additional driving elements for these mechanisms.

This overcrowding or closeness of the various elements of these mechanisms was considered unsatisfactory because of the excessive amount of loom down time necessary for the replacement or change in adjustment of said mechanisms and elements thereof.

The weft control device comprising the invention has eliminated the problems described above by providing a means which permits utilization of the selvage forming apparatus's thread cutter and which eliminates the former need for the waste selvage threads and conventional thread cutter.

SUMMARY OF THE INVENTION

The weft control device for shuttleless looms of the present invention includes an elongated guide block attached to the forward surface of the reed, adjacent the warp and is movable with said reed to and from weft beat-up position. The guide block serves to position the weft extending from a warp shed to the inserting carrier forwardly of the reed's dents in the vicinity immediately adjacent to the warp. As the reed moves toward beat-up position this portion of the weft is received and held by a hook integrally formed on a fixed and rearwardly extending bar member. This hook is effective in locating the weft in a position where it will be taken by the selvage forming apparatus's cutter and clamping device after beat-up of the pick when the reed and lay commence their movement away from beat-up position. During this initial movement of the lay and reed away from beat-up position the weft extends from the edge of the fabric, through the hook and then through an eyelet or slot in the rear wall of the extending carrier. From the carrier the weft extends to its source of supply as is well known to those conversant in the art. A rod member is adjustably attached to the lay and has one end which defines a camming surface that is disposed in close proximity with the hook when said lay is in the area of beat-up position. During movement of the lay and reed away from the beat-up position that portion of the weft extending from the hook to the carrier is caused to make contact with the camming surface of the rod member. At this time the combination of the lay moving rearwardly and the carrier moving toward the shed causes the weft to be cammed to the upper surface of the rod member whereat it is in position to be received into the gripping element provided in the forward wall of said carrier. The carrier then enters a new shed opening, the weft is cut and clamped by a mechanism forming a part of the selvage forming apparatus and the latter's selvage needle is then actuated to tuck the cut end into said new shed opening.

It is a general object of the invention to provide an improved means for forming a fabric selvage on the weft insertion side of single pick insertion type shuttleless looms.

It s a further object of the invention to provide a weft yarn control device for operative association with a loom's selvage forming appartus which has a minimum number of parts that are relatively inexpensive to manufacture and which perform their intended function in a positive manner.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
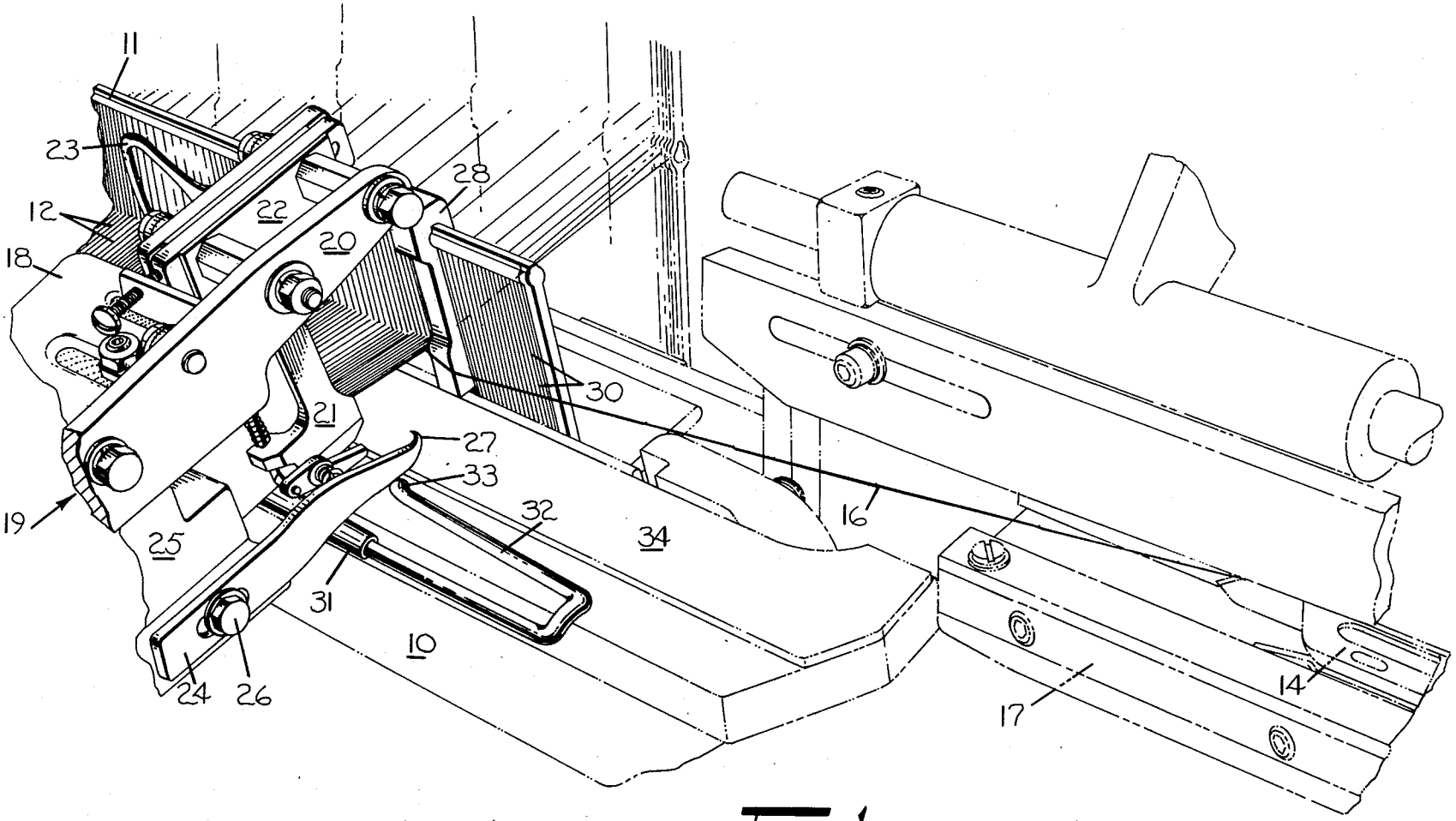
FIG. 1 is a perspective view of a portion of a shuttleless loom showing the device according to the invention applied thereto.
Figure 2:
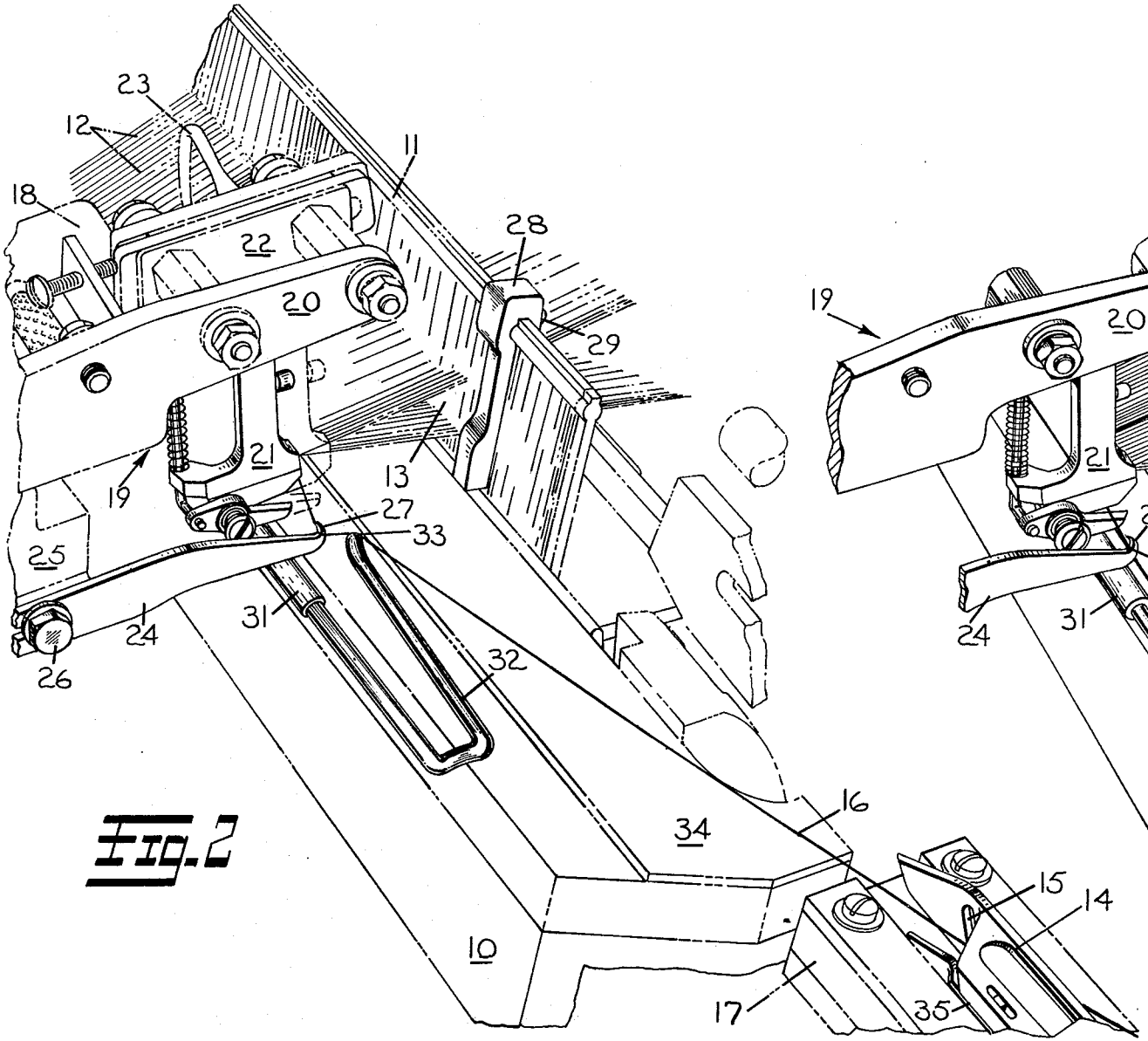
FIG. 2 is a perspective view similar to FIG. 1 showing the manner in which the hook positions the weft to be acted upon by the cam member and for its reception by the cutter and clamping device of the selvage forming apparatus.

Now referring to the figures of drawing enough of a single pick insertion type shuttleless loom is shown in FIGS. 1 and 2 to serve as a basis for a detailed description of the invention applied thereto.

Figure 3:
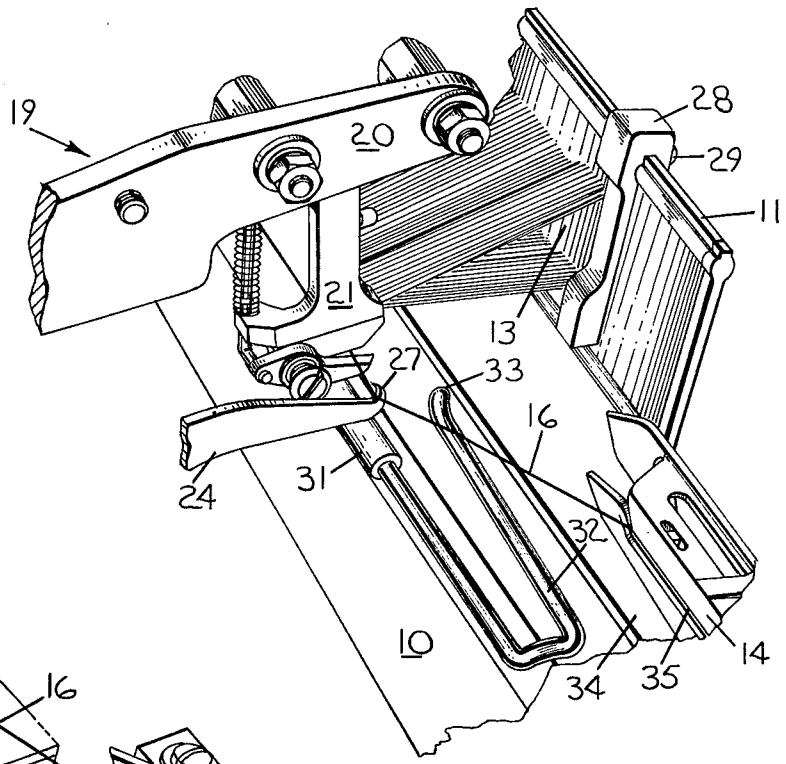
FIG. 3 is a perspective view similar to FIGS. 1 and 2 but showing the weft yarn cammed to a position to be received into the gripping element of the carrier and being taken by the cutter and clamping device.

In FIGS. 1 and 2 a portion of the forward upper right hand end of a shuttleless loom is shown and among the various parts thereof there is shown a lay beam 10 with a reed 11 carried thereon through which sheets of warp threads 12 extend to form shed openings 13 in a well known manner as illustrated in FIGS. 2 and 3.

The inserting carrier is identified by numeral 14 and as shown in FIG. 2 is provided with an angularly disposed slot 15 in the rear wall thereof through which weft yarn 16 remains threaded during the performance of said carrier's intended function.

As is well known to those familar with the art the carrier 14 is attached to the free end of a flexible type (not shown) which is alternatively wrapped about and unwrapped from an oscillating type wheel (not shown) disposed at the side of the loom. The usual form of tape guide 17 is fixed to the side of the loom in operative association with the tape wheel and serves to guide the flexible tape and carrier 14 during their movement into and from the sheds formed by warp threads 12.

With reference to FIGS. 1 and 2 the loom's right hand temple is shown at 18 and serves to maintain the fabric as it is formed at its so-called reeded width. Immediately adjacent to the temple 18 a portion of the loom's right-hand selvage forming apparatus is identified generally by numeral 19 which includes a support arm 20 and a depending weft cutter 21 that is movable during the performance of its intended function between the solid and phantom line positions shown in FIG. 2. This support arm 20 also carries a cam member 22 for actuating the cutter 21 and weft clamping device (not shown) but operatively connected thereto and disposed in close proximity with said cutter 21.

As shown in FIGS. 1 and 2 a portion of the selvage needle is shown at 23 and serves to tuck each cut end of weft into a shed opening to effect their beat-up into the fabric with each following pick.

The weft yarn control device according to the invention includes a rearwardly extending bar member 24 which is adjustably assembled to the side of a support bracket 25 by means of a cap screw 26. The free end of this bar terminates in a weft receiving and retaining hook 27 the function of which will be more fully described. Additionally the weft yarn control device includes an elongated guide block 28 which is adjustably attached to the reed 11 by such means as a set screw 29. This guide block 28 is assembled adjacent the warp and extends in a direction parallel with the dents 30 of the reed 11 (FIG. 1).

In general alignment with the guide block 28, the forward surface of the lay 10 has a sleeve member 31 fixed thereto by any suitable means not shown and has adjustably assembled therein one end of a U-shaped rod member 32. The opposite or free end of this U-shaped rod member 32 is curved downwardly as at 33 to a position in close proximity with the upper surface of the lay and below the upper surface of the carrier raceway 34 carried by said lay. The end 33 of the U-shaped rod member 32 defines a camming surface which is effective in elevating the weft 16 as the lay is moving away from the beat-up position to where it will enter the gripping element 35 (FIG. 3) provided in the forward wall of the inserting carrier as the latter moves toward a new shed opening to introduce the next pick.

To summarize the operation, the inserting carrier 14 enters a warp shed and is caused to meet a companion or so-called extending carrier at a point adjacent the center thereof where the end of weft yarn introduced by said inserting carrier is transferred, in a known manner, to said extending carrier and is drawn through the remainder of the shed to complete a single pick. During this time the weft remains threaded through the slot 15 in the rear wall of the inserting carrier and as the carrier leaves the shed the weft makes contact with the guide block 28 as shown in FIG. 1. The guide block is effective in positioning the weft forwardly of the dents 30 of the reed 11 in the area immediately adjacent to the warp and as the lay and reed move toward beat-up position the weft is engaged and retained by the hook 27 of the bar member 24 as shown in FIG. 2. In this position the weft 16 extends from the edge of the fabric through the hook 27 and engages the end 33 of the U-shaped rod member 32 as shown in FIG. 2. From the end 33, the weft extends through the slot 15 in the rear wall of the carrier14 and thence to its source. As the lay and reed commence to move away from beat-up position, a new shed opening is in the process of being formed and the carrier starts to move toward the shed to introduce the next pick. The combination of the lay and reed moving away from beat-up position and the carrier moving toward the shed causes that portion of the weft extending between the hook 27 and the slot 15 in the carrier to be cammed upwardly by end 33 to a position on the upper surface of rod member 32 as shown in FIG. 3. In this position the weft is located a sufficient distance above the raceway 34 so as to be guided into and retained by the gripping element 35 of the carrier as the latter moves toward the shed. As the carrier commences its entrance into the shed, the weft cutter 21 and clamping device (not shown) is timed to move from the solid line position to the phantom line position shown in FIG. 2. The weft is then cut and the end extending from the fabric is held by the clamping device until actuation of the selvage needle 23 which pulls the end out of said clamping device and tucks it into the shed. The other end of the weft is carried into the shed by the inserting carrier and presented to the extending carrier as heretofore described.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a loom of the single pick insertion type having a reciprocating lay, a reed, and inserting and extending carrier by means of which weft yarn from an outside source is introduced into sheds formed by warp threads and a selvage forming device for inserting the ends of a pick into a warp shed after beat-up by the reed, a weft yarn control device comprising:

a. means carried by the reed for positioning that portion of a pick adjacent the warp forwardly of the reed during the latter's movement toward beat-up position;

b. means carried by the loom for receiving the pick from said positioning means and holding it in a location for reception by the selvage forming device; and c. means defining a rod member operatively associated with said receiving means having a camming surface formed on one end thereof for engaging the weft and guiding the same to a position on the upper surface of said rod member to effect its reception into the weft gripping portion of the inserting carrier during movement of the reed away from beat-up position.

* * * * *